US006093521A

United States Patent [19]

Laney et al.

[11] Patent Number: 6,093,521

[45] Date of Patent: Jul. 25, 2000

[54] PHOTOGRAPHIC DAY/NIGHT DISPLAY MATERIAL WITH VOIDED POLYESTER

[75] Inventors: Thomas M. Laney, Hilton; Robert P. Bourdelais, Pittsford; Alphonse D. Camp, Rochester; Peter T. Aylward, Hilton, all of N.Y.

[73] Assignee: Eastman Kodak Company, Rochester, N.Y.

[21] Appl. No.: 09/217,750

[22] Filed: Dec. 21, 1998

[51] Int. Cl.[7] ..... G03C 1/46; G03C 1/795; G03C 1/91; G03C 1/825; G03C 7/32

[52] U.S. Cl. ..... 430/363; 430/494; 430/496; 430/502; 430/510; 430/533; 430/534; 430/950; 430/527

[58] Field of Search ..... 430/533, 534, 430/510, 496, 950, 502, 527, 494, 363

[56] References Cited

U.S. PATENT DOCUMENTS

| | | | |
|---|---|---|---|
| 4,187,113 | 2/1980 | Mathews et al. | 430/533 |
| 4,701,369 | 10/1987 | Duncan | 428/313.9 |
| 4,701,370 | 10/1987 | Park | 428/314.4 |
| 4,900,654 | 2/1990 | Pollock et al. | 430/533 |
| 5,084,334 | 1/1992 | Hamano et al. | 428/304.4 |
| 5,141,685 | 8/1992 | Maier et al. | 264/45.3 |
| 5,143,765 | 9/1992 | Maier et al. | 428/36.5 |
| 5,223,383 | 6/1993 | Maier et al. | 430/53.3 |
| 5,275,854 | 1/1994 | Maier et al. | 428/36.5 |
| 5,422,175 | 6/1995 | Ito et al. | 428/304.4 |
| 5,853,965 | 12/1998 | Haydock et al. | 430/536 |
| 5,866,282 | 2/1999 | Bourdelais et al. | 430/536 |
| 5,874,205 | 2/1999 | Bourdelais et al. | 430/536 |

FOREIGN PATENT DOCUMENTS

| | | |
|---|---|---|
| 0 470 760 A2 | 2/1992 | European Pat. Off. . |
| 0 880 065 A1 | 11/1998 | European Pat. Off. . |
| 0 880 067 A1 | 11/1998 | European Pat. Off. . |
| 0 880 069 A1 | 11/1998 | European Pat. Off. . |
| 2 215 268 | 9/1989 | United Kingdom . |
| 2 325 749 | 12/1998 | United Kingdom . |
| 2 325 750 | 12/1998 | United Kingdom . |

OTHER PUBLICATIONS

Japanese Abstract 85/31669 w/claims, Jul. 1985.
Japanese Abstract 5,057,836, Mar. 1993.
Japanese Abstract 7,137,216, w/claim May 1995.

*Primary Examiner*—Richard L. Schilling
*Attorney, Agent, or Firm*—Paul A. Leipold

[57] ABSTRACT

The invention relates to a photographic member comprising at least one photosensitive silver halide layer on the top of said member and at least one photosensitive silver halide layer on the bottom of said member, a polymer sheet comprising at least one layer of voided polyester polymer and at least one layer comprising nonvoided polyester polymer, wherein the imaging member has a percent transmission of between 38 and 42%, the imaging member further comprises tints, and the nonvoided layer is at least twice as thick as the voided layer.

25 Claims, No Drawings

PHOTOGRAPHIC DAY/NIGHT DISPLAY MATERIAL WITH VOIDED POLYESTER

FIELD OF THE INVENTION

This invention relates to photographic materials. In a preferred form it relates to base materials for photographic transmission display.

BACKGROUND OF THE INVENTION

It is known in the art that photographic display materials are utilized for advertising as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters and fine art photography. The desired attributes of a quality, high impact photographic display material are a slight blue density minimum, durability, sharpness and flatness. Cost is also important as display materials tend to be expensive compared with alternative display material technology mainly lithographic images on paper. For display materials, traditional color paper is undesirable as it suffers from a lack of durability for the handling, photographic processing and display of large format images.

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult requiring great care and expense to ensure proper laydown and cooling of the polyethylene layers. The formation of a suitably smooth surface would also improve image quality as the display material would have more apparent blackness as the reflective properties of the improved base are more specular than the prior materials. As the whites are whiter and the blacks are blacker, there is more range in between and, therefore, contrast is enhanced. It would be desirable if a more reliable and improved surface could be formed at less expense.

Prior art photographic reflective papers comprise a melt extruded polyethylene layer which also serves as a carrier layer for optical brightener and other whitener materials as well as tint materials. It would be desirable if the optical brightener, whitener materials and tints, rather than being dispersed a single melt extruded layer of polyethylene could be concentrated nearer the surface where they would be more effective optically.

Prior art photographic display materials typically are optimized for either a transmission display materials or a reflection display material. Photographic finishing labs are therefore required to inventory two different types of display materials. Further, when the illuminating light source for a transmission display materials is turned off, the display image quality in reflection is unacceptable.

Prior art photographic transmission display materials with incorporated diffusers have light sensitive silver halide emulsions coated directly onto a gelatin coated clear polyester sheet. Incorporated diffusers are necessary to diffuse the light source used to backlight transmission display materials. Without a diffuser, the light source would reduce the quality of the image. Typically, white pigments are coated in the bottom most layer of the imaging layers. Since light sensitive silver halide emulsions tend to be yellow because of the gelatin used as a binder for photographic emulsions minimum density areas of a developed image will tend to appear yellow. A yellow white reduces the commercial value of a transmission display material because the imaging viewing public associates image quality with whiter whites and furthermore yellow white are perceived as old. It would be desirable if a transmission display material with an incorporated diffuser could have a more blue white.

Prior art transmission display materials use a high coverage of light sensitive silver halide emulsion to increase the density of the image compared to photographic reflective print materials. While increasing the coverage does increase the density of the image in transmission space, the time to image development is also increased as the coverage increases. Typically, a high density transmission display material has a developer time of 110 seconds compared to a developer time of 45 seconds or less for photographic print materials. Prior art high density transmission display materials, when processed, reduce the productivity of the development lab. Further, coating a high coverage of emulsion requires additional drying of the emulsion in manufacturing reducing the productivity of emulsion coating machines. It would be desirable if a transmission display material was high in density and had a developer time less than 50 seconds.

Prior art photographic transmission display materials with incorporated diffusers have light sensitive silver halide emulsions coated directly onto a gelatin subbed clear polyester sheet. $TiO_2$ is added to the bottom most layer of the imaging layers to diffuse light so well that individual elements of the illuminating bulbs utilized are not visible to the observer of the displayed image. However, coating $TiO_2$ in the imaging layer causes manufacturing problems such as increased coating coverage which requires more coating machine drying and a reduction in coating machine productivity as the $TiO_2$ requires additional cleaning of coating machine. Further, as higher amounts of $TiO_2$ are used to diffuse high intensity backlighting systems, the $TiO_2$ coated in the bottom most imaging layer causes unacceptable light scattering reducing the quality of the transmission image. It would be desirable to eliminate the $TiO_2$ from the image layers while providing the necessary transmission properties and image quality properties.

An example of coextruded thin layer technology improvements and limitations is explained in U.S. Pat. No. 5,476,708 where it is proposed that sharpness improvements in photographic systems can be achieved by an untinted, unpigmented melt extruded thin skin made to be used under a light sensitive emulsion. It would be desirable if a thin skin under the emulsion could be both coextruded microvoided biaxially oriented to provide stiffness and a more efficient diffusing layer and tinted blue to provide the necessary color correction for the yellowness of the light sensitive silver halide imaging layer.

PROBLEM TO BE SOLVED BY THE INVENTION

There is a need for transmission display materials that provide improved transmission of light while, at the same time, more efficiently diffusing the light such that the elements of the light source are not apparent to the viewer.

SUMMARY OF THE INVENTION

It is an object of the invention to provide improved transmission display materials.

It is another object to provide display materials that are lower in cost, as well as providing sharp durable images.

It is a further object to provide more efficient use of the light used to illuminate transmission display materials.

It is another object to provide a display material that an function as both a transmissions display material and a reflection display material.

It is a further object to provide a product that may be provided with a silver halide image on each side but still retain a single exposure step and short processing time.

These and other objects of the invention are accomplished by a photographic member comprising at least one photosensitive silver halide layer on the top of said member and at least one photosensitive silver halide layer on the bottom of said member, a polymer sheet comprising at least one layer of voided polyester polymer and at least one layer comprising nonvoided polyester polymer, wherein the imaging member has a percent transmission of between 38 and 42%, the imaging member further comprises tints, and the nonvoided layer is at least twice as thick as the voided layer.

ADVANTAGEOUS EFFECT OF THE INVENTION

The invention provides brighter images by allowing more efficient diffusion of light used to illuminate display materials.

DETAILED DESCRIPTION OF THE INVENTION

The invention has numerous advantages over prior transmission display materials and methods of imaging transmission display materials. The display materials of the invention provide very efficient diffusing of light while allowing the transmission of a high percentage of the light. The layers of the coextruded polyester sheet of this invention have levels of voiding, optical brightener, and colorants adjusted to provide optimum transmission properties. The polyester sheet has a voided layer to efficiently diffuse the illuminating light source common with transmission display materials without the use of expensive $TiO_2$ or other white pigments. The coextruded polyester base of the invention contains a clear polyester layer to provide stiffness without corrupting the transmission of light. The thickness ratio between the voided layer and the clear layer is at least 1:2. Below a 1:2 ratio, the support would not allow sufficient illumination for a quality image, as the voided layer would be too thick to allow for illumination of the image. The polyester sheet of this invention preferably has a coextruded integral emulsion adhesion layer. Beyond the transparent layer and the voided layer, a coextruded polyethylene layer can be used with corona discharge treatment as a silver halide emulsion adhesion layer, avoiding the need for a primer coating common with polyester sheets. A polyethylene layer with corona discharge treatment is preferred because gelatin based silver halide emulsions adhere well to treated polyethylene without the need for primer coatings. Further, the integral polyethylene skin layer may also contain blue tints and optical brightener to compensate for the native yellowness of the gelatin based silver halide emulsion. The voided, oriented polyester sheet of this invention is also low in cost, as the functional layer is coextruded at the same time, avoiding the need for further processing such as lamination, priming, or extrusion coating. The material as it contains in its preferred form silver halide imaging layers on both sides of a polymer sheet may be imaged by a collimated beam exposure device in a single exposure. As there are two relatively thin layers of silver halide image materials, the developing of the invention element may be carried out rapidly as the penetration of the developing solution is rapid through the thin layers of imaging material. The materials are low in cost as the coextruded microvoided polymer material sheet is made in one step. Prior art products are typically a two step process or incorporate a bottom pigmented layer during emulsion coating which adds to the drying load and slow the coating process down. The formation of transmission display materials requires a display material that diffuses light so well that individual elements of the illuminating bulbs utilized are not visible to the observer of the displayed image. On the other hand, it is necessary that light be transmitted efficiently to brightly illuminate the display image. The invention allows a greater amount of illuminating light to actually be utilized as display illumination while at the same time very effectively diffusing the light sources such that they are not apparent to the observer. The display material of the invention will appear whiter to the observer than prior art materials which have a tendency to appear somewhat yellow as they require a high amount of light scattering pigments to prevent the viewing of individual light sources. These high concentrations of pigments appear yellow to the observer and result in an image that is darker than desirable. These and other advantages will be apparent from the detailed description below.

The terms as used herein, "top", "upper", "emulsion side", and "face" mean the side or toward the side of the polyethylene layer. The terms "bottom", "lower side", and "back" mean the side opposite of the polyethylene layer. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer. The term as used herein, "duplitized" element means elements with light sensitive silver halide coating on the top side and the bottom side of the imaging support.

The layers of the coextruded biaxially oriented polyester sheet of this invention have levels of voiding, $TiO_2$ and colorants adjusted to provide optimum transmission properties. The biaxially oriented polyester sheet is coextruded as a multi-layer base that has a transparent polymer base and a thin microvoided layer for efficient diffusing for backlite applications, enhanced image processing as well as product handling for display assembling. An important aspect of this invention is the imaging support is coated with a light sensitive silver halide emulsion on the top side and the bottom side, this duplitized silver halide coating combined with the optical properties of the biaxially oriented sheet provides an improved photographic display material that can be used in transmission. The duplitized display material of this invention has significant commercial value in that prior art photographic display materials required a developer time of 110 seconds compared to a developer time of 45 seconds for the invention. It has been found that the duplitized emulsion top side to bottom side coverage ratio should be in a range of 1:0.6 to 1:1.25. It has been shown that the duplitized emulsion top side to bottom side coverage ratio of 1:1.25 resulted in significant and adverse attenuation of the imaging light which resulted in under exposure of the bottom side emulsion coating. Conversely, a duplitized emulsion top side to bottom side coverage ratio of less than 1:0.6 resulted in significant and adverse attenuation of the imaging light which resulted in over exposure of the top side emulsion coating. The preferred duplitized emulsion top side to bottom side coverage ratio is 1:1. A 1:1 ratio allows for efficient exposure and the required dye density for a quality image. In the above case said photographic imaging element a photosensitive silver halide and dye forming coupler in both the top and bottom layers. In order to provided the a photographic element for this application one preferred structure comprises a photographic member comprising at least one photosensitive silver halide layer on the top of said member and at least one photosensitive silver halide layer on the bottom of said layer, a polymer sheet comprising at least one layer of voided polyester polymer and at least one layer comprising nonvoided polyester polymer, wherein the imaging member has a percent transmission of between 38 and 42%, the imaging member further comprises tints, and the nonvoided layer is at least twice as thick as the voided layer. This structure is preferred because it provides an optimized integral diffusing screen that is part of the base element structure. The diffusing properties are highly desirable in backlit applications. A backside primer or subbing coating is necessary when a coating gelatin based emulsion layers on the backside because gelatin does not adhere well to polyester. Furthermore a layer of polyethylene may be desirable to enhance adhesion of the backside silver halide emulsion as opposed to a gel sub layer. It should be noted that if two sides of the substrate are coated with light sensitive silver halide emulsions, then both sides need to be cornea treated prior to the first light sensitive layer being applied to the substrate or the emulsion will be fogged.

In the case of a duplitized emulsion it may be desirable to further comprise said photographic element with an antihalation layer over the outer most part of the backside emulsion. The antihalation layer is typically a layer of gelatin with "black" or exposed silver. The purpose of such a layer is to provide improved sharpness and to prevent the reexposure of the silver grains once the light has passes through the emulsion.

Any suitable polyester sheet may be utilized for the member provided that it is oriented. The orientation provides added strength to the multi-layer structure that provides enhanced handling properties when displays are assembled. Microvoided oriented sheets are preferred because the voids provide opacity without the use of $TiO_2$. Microvoided layers are conveniently manufactured by coextrusion of the core and thin layers, followed by biaxial orientation, whereby voids are formed around void-initiating material contained in the thin layers.

The total thickness of the sheet can range from 76 to 256 μm, preferably from 80 to 150 μm. Below 80 μm, the microvoided sheets may not be thick enough to minimize any inherent handling and kinking problems when handling large sheets of this material. At thickness higher than 150 μm, little improvement in either surface smoothness or mechanical properties are seen, and so there is little justification for the further increase in cost for extra materials. In the case of the preferred photographic imaging member, the microvoided layer should have a thickness between 6–50 μm. Below 6 μm, the diffusing properties of the layer are minimized and above 50 the layer becomes more opaque and hinders the quality for backlighting applications with silver halide emulsion on each side.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

For the biaxially oriented layer on the top side towards the emulsion, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polyethylene is preferred, as it is low in cost and good adhesion properties to the photographic emulsion. The polyethylene layer may comprise at least one layer of said polymer base sheet and in particular it may comprises a layer on top of said voided polyester layer Another means to enhance adhesion of a photographic silver halide emulsion on a the polyester polymer surface of claim one of this invention is to apply a subbing layer. Typical subbing layer may contain materials known in the art to promote adhesion to polyester and furthermore allow gelatin to adhere to the sub layer.

Addenda may be added to the top most skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are preferred as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments and pigment Blue 60.

A finding that a very thin coating (0.2 to 1.5 μm) on the surface immediately below the emulsion layer can be made by coextrusion and subsequent stretching in the width and length direction. It has been found that this layer is, by nature, extremely accurate in thickness and can be used to provide all the color corrections which are usually distributed throughout the thickness of the sheet between the emulsion and the paper base. This topmost layer is so efficient that the total colorants needed to provide a correction are less than one-half the amount needed if the colorants are dispersed throughout thickness. Colorants are often the cause of spot defects due to clumps and poor dispersions. Spot defects, which decrease the commercial value of images, are improved with this invention because less colorant is used and high quality filtration to clean up the colored layer is much more feasible since the total volume of polymer with colorant is only typically 2 to 10 percent of the total polymer between the base paper and the photosensitive layer.

Addenda may be added to the biaxially oriented sheet of this invention so that when the biaxially oriented sheet is viewed by the intended audience, the imaging element emits light in the visible spectrum when exposed to ultraviolet radiation. Emission of light in the visible spectrum allows for the support to have a desired background color in the presence of ultraviolet energy. This is particularly useful when images are backlit with a light source that contains ultraviolet energy and may be used to optimize image quality for transmission display applications.

Addenda known in the art to emit visible light in the blue spectrum are preferred. Consumers generally prefer a slight blue tint to white defined as a negative b* compared to a white defined as a b* within one b* unit of zero. b* is the measure of yellow/blue in CIE space. A positive b* indicates yellow while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated ultraviolet light source and a light source without any significant ultraviolet energy. Delta b* is the preferred measure to determine the net effect of adding an optical brightener to the top biaxially oriented sheet of this invention. Emissions less than 1 b* unit can not be noticed by most customers therefore is it not cost effective to add optical brightener to the biaxially oriented sheet. An emission greater that 5 b* units would interfere with the color balance of the prints making the whites appear too blue for most consumers.

The preferred addenda of this invention is an optical brightener. An optical brightener is substantially colorless, fluorescent, organic compound that absorbs ultraviolet light and emits it as visible blue light. Examples include but are not limited to derivatives of 4,4'-diaminostilbene-2,2'-disulfonic acid, coumarin derivatives such as 4-methyl-7-diethylaminocoumarin, 1-4-Bis (O-Cyanostyryl) Benzol and 2-Amino-4-Methyl Phenol. An unexpected desirable feature of this efficient use of optical brightener. Because the ultraviolet source for a transmission display material is on the opposite side of the image, the ultraviolet light intensity is not reduced by ultraviolet filters common to imaging layers. The result is less optical brightener is required to achieve the desired background color.

The photographic imaging element that comprises a polymer sheet with at least one voided polyester skin layer and at least one nonvoided polyester polymer layer should comprise a void space between about 2 and 60% by volume of said voided layer of said polymer sheet. Such a void concentration is desirable to optimize the transmission and reflective properties while providing adequate diffusing power to hide back lights and filaments.

The biaxially oriented coextruded polymer sheet may also contain white pigments which are known to improve the photographic responses such as whiteness or sharpness. Titanium dioxide is used in this invention to improve image sharpness. The $TiO_2$ used may be either anatase or rutile type. In the case of optical properties, rutile is the preferred because of the unique particle size and geometry. Further, both anatase and rutile $TiO_2$ may be blended to improve both whiteness and sharpness. Examples of $TiO_2$ that are acceptable for a photographic system are Dupont Chemical Co. R101 rutile $TiO_2$ and DuPont Chemical Co. R104 rutile $TiO_2$. Other pigments to improve photographic responses may also be used in this invention such as titanium dioxide, barium sulfate, clay, or calcium carbonate.

The preferred amount of $TiO_2$ added to the biaxially oriented sheet of this invention is between 4 and 18% by weight. Below 3% $TiO_2$, the required light transmission can not be easily achieved with microvoiding alone. Combining greater than 4% $TiO_2$ with voiding provides a biaxially oriented, micro voided sheet that is low in cost. Above 14% $TiO_2$, additional dye density is required to overcome the loss in transmission.

The preferred spectral transmission for a day/night biaxially oriented coextruded polyester sheet of this invention is at between 38 to 42%. This range is preferred because it provides for optimal viewing with either backlighting or front viewing in daylight or room light conditions. Spectral transmission is the amount of light energy that is transmitted through a material. For a photographic element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer. The higher the transmission, the less opaque the material. For a transmission display material with an incorporated diffuser, the quality of the image is related to the amount of light reflected from the image to the observers eye. A transmission display image with a low amount of spectral transmission does not allow sufficient illumination of the image causing a perceptual loss in image quality. A transmission image with a spectral transmission of less than 35% is unacceptable for a transmission display material as the quality of the image can not match prior art transmission display materials. Further, spectral transmissions less than 35% will require additional dye density which increases the cost of the transmission display material. Any spectral transmission greater than 40% provides acceptable image quality. However as the spectral transmission approaches 75%, it has been found that the materials does not sufficiently diffuse the backlighting illuminate.

These coextruded sheets may be coated or treated after the coextrusion and orienting process or between casting and full orientation with any number of coatings which may be used to improve the properties of the sheets including printability, to provide a vapor barrier, or to improve the adhesion to the support or to the photo sensitive layers. Examples of this would be acrylic coatings for printability, coating polyvinylidene chloride for heat seal properties or barrier properties. Further examples include flame, plasma or corona discharge treatment to improve printability or adhesion. In addition it is also possible to provide either an integral layer or a separately coated layer of either an electrical conductive or charge control layer to minimized the generation of electrostatic glow or discharge of a photosensitive imaging member. The preferred embodiment is a photographic member comprising at least one photosensitive silver halide layer on the top of said member and at least one photosensitive silver halide layer on the bottom of said layer, a polymer sheet comprising at least one layer of voided polyester polymer and at least one layer comprising nonvoided polyester polymer, wherein the imaging member has a percent transmission of between 38 and 42%, the imaging member further comprises tints, and the nonvoided layer is at least twice as thick as the voided layer and the member further comprises at least one layer comprising a charge control and or having a electrical resistivity of less than $10^{11}$ ohms per square below the said polyethylene layer of the top most part of the base member. In the case of a charge control layer that is either integral to another functional layer or a functional layer by itself, the charge control agents should be substantially electrical neutral to the photosensitive emulsion or its protective overcoat.

The polyester utilized in the invention should have a glass transition temperature between about 50° C. and about 150° C., preferably about 60–100° C., should be orientable, and have an intrinsic viscosity of at least 0.50, preferably 0.6 to 0.9. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoiso-phthalic, and mixtures thereof. Examples of suitable glycols include ethylene glycol, propylene glycol, butanediol, pentanediol, hexanediol, 1,4-cyclohexane-dimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Polypropylene is also useful. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

Suitable cross-linked polymers for the microbeads used in void formation during sheet formation are polymerizable organic materials which are members selected from the group consisting of an alkenyl aromatic compound having the general formula

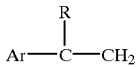

wherein Ar represents an aromatic hydrocarbon radical, or an aromatic halohydrocarbon radical of the benzene series and R is hydrogen or the methyl radical; acrylate-type monomers including monomers of the formula

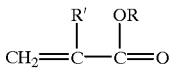

wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having the formula

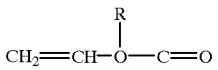

wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, oiallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene. The voided layer of the photographic member comprising at least one photosensitive silver halide layer on the top of said member and at least one photosensitive silver halide layer on the bottom of said layer, a polymer sheet comprising at least one layer of voided polyester polymer and at least one layer comprising nonvoided polyester polymer, wherein the imaging member has a percent transmission of between 38 and 42%, the imaging member further comprises tints, and the nonvoided layer is at least twice as thick as the voided layer contains organic particles that are the void initiating material for the voided layer.

Processes well known in the art yield nonuniformly sized particles, characterized by broad particle size distributions. The resulting beads can be classified by screening to produce beads spanning the range of the original distribution of sizes. Other processes such as suspension polymerization and limited coalescence directly yield very uniformly sized particles. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

It is preferred to use the "limited coalescance" technique for producing the coated, cross-linked polymer microbeads. This process is described in detail in U.S. Pat. No. 3,615,972. Preparation of the coated microbeads for use in the present invention does not utilize a blowing agent as described in this patent, however.

The following general procedure may be utilized in a limited coalescence technique:

1. The polymerizable liquid is dispersed within an aqueous nonsolvent liquid medium to form a dispersion of droplets having sizes not larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and 3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid, and hence the diameter of the beads of polymer, can be varied predictably, by deliberate variation of the composition of the aqueous liquid dispersion, within the range of from about one-half of a $\mu$m or less to about 0.5 centimeter. For any specific operation, the range of diameters of the droplets of liquid, and hence of polymer beads, has a factor in the order of three or less as contrasted to factors of 10 or more for diameters of droplets and beads prepared by usual suspension polymerization methods employing critical agitation procedures. Since the bead size, e.g., diameter, in the present method is determined principally by the composition of the aqueous dispersion, the mechanical conditions, such as the degree of agitation, the size and design of the apparatus used, and the scale of operation, are not highly critical. Furthermore, by employing the same composition, the operations can be repeated, or the scale of operations can be changed, and substantially the same results can be obtained.

The present method is carried out by dispersing one part by volume of a polymerizable liquid into at least 0.5, preferably from 0.5 to about 10 or more, parts by volume of a nonsolvent aqueous medium comprising water and at least the first of the following ingredients:

1. A water-dispersible, water-insoluble solid colloid, the particles of which, in aqueous dispersion, have dimensions in the order of from about 0.008 to about 50 nm, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, surface-active agents and the like; and usually,
5. A water-soluble, monomer-insoluble inhibitor of polymerization.

The water-dispersible, water-insoluble solid colloids can be inorganic materials such as metal salts or hydroxides or clays, or can be organic materials such as raw starches, sulfonated cross-linked organic high polymers, resinous polymers, and the like.

The solid colloidal material must be insoluble but dispersible in water and both insoluble and nondispersible in, but wettable by, the polymerizable liquid. The solid colloids must be much more hydrophilic than oleophilic so as to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size is approximately that of the swollen particle. The particles can be essentially single molecules, as in the case of extremely high molecular weight cross-linked resins, or can be aggregates of many molecules. Materials that disperse in water to form true or colloidal solutions in which the particles have a size below the range stated or in which the particles are so diffuse as to lack a discernible shape and dimension are not suitable as stabilizers for limited coalescence. The amount of solid colloid that is employed is usually such as corresponds to from about 0.01 to about 10 or more grams per 100 cubic centimeters of the polymerizable liquid.

In order to function as a stabilizer for the limited coalescence of the polymerizable liquid droplets, it is essential that the solid colloid must tend to collect with the aqueous liquid at the liquid-liquid interface, i.e., on the surface of the oil droplets. (The term "oil" is occasionally used herein as generic to liquids that are insoluble in water.) In many instances, it is desirable to add a "promoter" material to the aqueous composition to drive the particles of the solid colloid to the liquid-liquid interface. This phenomenon is well known in the emulsion art, and is here applied to solid colloidal particles, as an expanded of adjusting the "hydrophilic-hydrophobic balance."

Usually, the promoters are organic materials that have an affinity for the solid colloid and also for the oil droplets and that are capable of making the solid colloid more oleophilic. The affinity for the oil surface is usually due to some organic portion of the promoter molecule, while affinity for the solid colloid is usually due to opposite electrical charges. For example, positively charged complex metal salts or hydroxides, such as aluminum hydroxide, can be promoted by the presence of negatively charged organic promoters such as water-soluble sulfonated polystyrenes, alignates, and carboxymethylcellulose. Negatively charged colloids, such as Bentonite, are promoted by positively charged promoters such as tetramethyl ammonium hydroxide or chloride or water-soluble complex resinous amine condensation products, such as the water-soluble condensation products of diethanolamine and adipic acid, the water-soluble condensation products of ethylene oxide, urea and formaldehyde, and polyethylenimine. Amphoteric materials such as proteinaceous materials like gelatin, glue, casein, albumin, glutin and the like are effective promoters for a wide variety of colloidal solids. Nonionic materials like methoxycellulose are also effective in some instances. Usually, the promoter need be used only to the extent of a few parts per million of aqueous medium, although larger proportions can often be tolerated. In some instances, ionic materials normally classed as emulsifiers, such as soaps, long chain sulfates and sulfonates and the long chain quaternary ammonium compounds, can also be used as promoters for the solid colloids, but care must be taken to avoid causing the formation of stable colloidal emulsions of the polymerizable liquid and the aqueous liquid medium.

An effect similar to that of organic promoters is often obtained with small amounts of electrolytes, e.g., water-soluble, ionizable alkalies, acids and salts, particularly those having polyvalent ions. These are especially useful when the excessive hydrophilic or insufficient oleophilic characteristic of the colloid is attributable to excessive hydration of the colloid structure. For example, a suitably cross-linked sulfonated polymer of styrene is tremendously swollen and hydrated in water. Although the molecular structure contains benzene rings which should confer on the colloid some affinity for the oil phase in the dispersion, the great degree of hydration causes the colloidal particles to be enveloped in a cloud of associated water. The addition of a soluble, ionizable polyvalent cationic compound, such as an aluminum or calcium salt, to the aqueous composition causes extensive shrinking of the swollen colloid with exudation of a part of the associated water and exposure of the organic portion of the colloid particle, thereby making the colloid more oleophilic.

The solid colloidal particles whose hydrophilic-hydrophobic balance is such that the particles tend to gather in the aqueous phase at the oil-water interface, gather on the surface of the oil droplets and function as protective agents during limited coalescence.

Other agents that can be employed in an already known manner to effect modification of the colloidal properties of the aqueous composition are those materials known in the art as peptizing agents, flocculating and deflocculating agents, sensitizers, surface active agents, and the like.

It is sometimes desirable to add to the aqueous liquid a few parts per million of a water-soluble, oil-insoluble inhibitor of polymerization effective to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid is then admixed with the liquid polymerizable material in such a way as to disperse the liquid polymerizable material as small droplets within the aqueous medium. This dispersion can be accomplished by any usual means, e.g., by mechanical stirrers or shakers, by pumping through jets, by impingement, or by other procedures causing subdivision of the polymerizable material into droplets in a continuous aqueous medium.

The degree of dispersion, e.g., by agitation is not critical except that the size of the dispersed liquid droplets must be no larger, and is preferably much smaller, than the stable droplet size expected and desired in the stable dispersion. When such condition has been attained, the resulting dispersion is allowed to rest with only mild, gentle movement, if any, and preferably without agitation. Under such quiescent conditions, the dispersed liquid phase undergoes a limited degree of coalescence.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which can be as large as 0.3 and sometimes 0.5 centimeter in diameter, are quite stable as regards further coalescence and are remarkably uniform in size. If such a large droplet dispersion be vigorously agitated, the droplets are fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying this phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, i.e., on the surface of the oil droplets. It is thought that droplets which are substantially covered by such solid colloid are stable to coalescence while droplets which are not so covered are not stable. In a given dispersion of a polymerizable liquid the total surface area of the droplets is a function of the total volume of the liquid and the diameter of the droplets. Similarly, the total surface area barely coverable by the solid colloid, e.g., in a layer one particle thick, is a function of the amount of the colloid and the dimensions of the particles thereof. In the dispersion as initially prepared, e.g., by agitation, the total surface area of the polymerizable liquid droplets is greater than can be covered by the solid colloid. Under quiescent conditions, the unstable droplets begin to coalesce. The coalescence results in a decrease in the number of oil droplets and a decrease in the total surface area thereof up to a point at which the amount of colloidal solid is barely sufficient substantially to cover the total surface of the oil droplets, whereupon coalescence substantially ceases.

If the solid colloidal particles do not have nearly identical dimensions, the average effective dimension can be estimated by statistical methods. For example, the average effective diameter of spherical particles can be computed as the square root of the average of the squares of the actual diameters of the particles in a representative sample.

It is usually beneficial to treat the uniform droplet suspension prepared as described above to render the suspension stable against congregation of the oil droplets.

This further stabilization is accomplished by gently admixing with the uniform droplet dispersion an agent capable of greatly increasing the viscosity of the aqueous liquid. For this purpose, there may be used any water-soluble or water-dispersible thickening agent that is insoluble in the oil droplets and that does not remove the layer of solid colloidal particles covering the surface of the oil droplets at the oil-water interface. Examples of suitable thickening agents are sulfonated polystyrene (water-dispersible, thickening grade), hydrophilic clays such as Bentonite, digested starch, natural gums, carboxy-substituted cellulose ethers, and the like. Often the thickening agent is selected and employed in such quantities as to form a thixotropic gel in which are suspended the uniform-sized droplets of the oil. In other words, the thickened liquid generally should be non-Newtonian in its fluid behavior, i.e., of such a nature as to prevent rapid movement of the dispersed droplets within the aqueous liquid by the action of gravitational force due to the difference in density of the phases. The stress exerted on the surrounding medium by a suspended droplet is not sufficient to cause rapid movement of the droplet within such non-Newtonian media. Usually, the thickener agents are employed in such proportions relative to the aqueous liquid that the apparent viscosity of the thickened aqueous liquid is in the order of at least 500 centipoises (usually determined by means of a Brookfield viscosimeter using the No. 2 spindle at 30 r.p.m.). The thickening agent is preferably prepared as a separate concentrated aqueous composition that is then carefully blended with the oil droplet dispersion.

The resulting thickened dispersion is capable of being handled, e.g., passed through pipes, and can be subjected to polymerization conditions substantially without mechanical change in the size or shape of the dispersed oil droplets.

The resulting dispersions are particularly well suited for use in continuous polymerization procedures that can be carried out in coils, tubes, and elongated vessels adapted for continuously introducing the thickened dispersions into one end and for continuously withdrawing the mass of polymer beads from the other end. The polymerization step is also practiced in batch manner.

The order of the addition of the constituents to the polymerization usually is not critical, but beneficially it is more convenient to add to a vessel the water, dispersing agent, and incorporated the oil-soluble catalyst to the monomer mixture, and subsequently add with agitation the monomer phase to the water phase.

The following is an example illustrating a procedure for preparing the cross-linked polymeric microbeads coated with slip agent. In this example, the polymer is polystyrene cross-linked with divinylbenzene. The microbeads have a coating of silica. The microbeads are prepared by a procedure in which monomer droplets containing an initiator are sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX (a colloidal suspension containing 50% silica sold by DuPont). A monomer phase is prepared by combining 3317 g styrene, 1421 g divinylbenzene (55% active cross-linking agent; other 45% is ethyl vinyl benzene which forms part of the styrene polymer chain) and 45 g VAZO 52 (a monomer-soluble initiator sold by DuPont). The mixture is passed through a homogenizer to obtain 5 $\mu$m droplets. The suspension is heated overnight at 52° C. to give 4.3 kg of generally spherical microbeads having an average diameter of about 5 mm with narrow size distribution (about 2–10 mm size distribution). The mol proportion of styrene and ethyl vinyl benzene to divinylbenzene is about 6.1%. The concentration of divinylbenzene can be adjusted up or down to result in about 2.5–50% (preferably 10–40%) cross-linking by the active cross-linker. Of course, monomers other than styrene and divinylbenzene can be used in similar suspension polymerization processes known in the art. Also, other initiators and promoters may be used as known in the art. Also, slip agents other than silica may also be used. For example, a number of LUDOX colloidal silicas are available from DuPont. LEPANDIN colloidal alumina is available from Degussa. NALCOAG colloidal silicas are available from Nalco, and tin oxide and titanium oxide are also available from Nalco.

Normally, for the polymer to have suitable physical properties such as resiliency, the polymer is cross-linked. In the case of styrene cross-linked with divinylbenzene, the polymer is 2.5–50% cross-linked, preferably 20–40% cross-linked. By percent cross-linked, it is meant the mol % of cross-linking agent based on the amount of primary monomer. Such limited cross-linking produces microbeads which are sufficiently coherent to remain intact during orientation of the continuous polymer. Beads of such cross-linking are also resilient, so that when they are deformed (flattened) during orientation by pressure from the matrix polymer on opposite sides of the microbeads, they subsequently resume their normal spherical shape to produce the largest possible voids around the microbeads to thereby produce articles with less density.

The microbeads are referred to herein as having a coating of a "slip agent". By this term it is meant that the friction at the surface of the microbeads is greatly reduced. Actually, it is believed this is caused by the silica acting as miniature ball bearings at the surface. Slip agent may be formed on the surface of the microbeads during their formation by including it in the suspension polymerization mix.

Microbead size is regulated by the ratio of silica to monomer. For example, the following ratios produce the indicated size microbead:

| Microbead Size, mm | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The microbeads of cross-linked polymer range in size from 0.1–50 mm, and are present in an amount of 5–50% by weight based on the weight of the polyester. Microbeads of polystyrene should have a Tg of at least 20° C. higher than the Tg of the continuous matrix polymer and are hard compared to the continuous matrix polymer.

Elasticity and resiliency of the microbeads generally result in increased voiding, and it is preferred to have the Tg of the microbeads as high above that of the matrix polymer as possible to avoid deformation during orientation. It is not believed that there is a practical advantage to cross-linking above the point of resiliency and elasticity of the microbeads.

The microbeads of cross-linked polymer are at least partially bordered by voids. The void space in the supports should occupy 2–60%, preferably 30–50%, by volume of the film support. Depending on the manner in which the supports are made, the voids may completely encircle the microbeads, e.g., a void may be in the shape of a doughnut (or flattened doughnut) encircling a micro-bead, or the voids may only partially border the microbeads, e.g., a pair of voids may border a microbead on opposite sides.

During stretching the voids assume characteristic shapes from the balanced biaxial orientation of paperlike films to the uniaxial orientation of microvoided/satinlike fibers. Balanced microvoids are largely circular in the plane of orientation, while fiber microvoids are elongated in the direction of the fiber axis. The size of the microvoids and the ultimate physical properties depend upon the degree and balance of the orientation, temperature and rate of stretching, crystallization kinetics, the size distribution of the microbeads, and the like.

The film supports according to this invention are prepared by:

(a) forming a mixture of molten continuous matrixpolymer and cross-linked polymer wherein the cross-linked polymer is a multiplicity of microbeads uniformly dispersed throughout the matrix polymer, the matrix polymer being as described hereinbefore, the cross-linked polymer microbeads being as described hereinbefore, (b) forming a film support from the mixture by extrusion or casting, (c) orienting the article by stretching to form microbeads of cross-linked polymer uniformly distributed throughout the article and voids at least partially bordering the microbeads on sides thereof in the direction, or directions of orientation.

The mixture may be formed by forming a melt of the matrix polymer and mixing therein the cross-linked polymer. The cross-linked polymer may be in the form of solid or semisolid microbeads. Due to the incompatibility between the matrix polymer and cross-linked polymer, there is no attraction or adhesion between them, and they become uniformly dispersed in the matrix polymer upon mixing.

When the microbeads have become uniformly dispersed in the matrix polymer, a film support is formed by processes such as extrusion or casting. Examples of extrusion or casting would be extruding or casting a film or sheet. Such forming methods are well known in the art. If sheets or film material are cast or extruded, it is important that such article be oriented by stretching, at least in one direction. Methods of unilaterally or bilaterally orienting sheet or film material are well known in the art. Basically, such methods comprise stretching the sheet or film at least in the machine or longitudinal direction after it is cast or extruded an amount of about 1.5–10 times its original dimension. Such sheet or film may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in such U.S. Pat. No. 3,903,234.

The voids, or void spaces, referred to herein surrounding the microbeads are formed as the continuous matrix polymer is stretched at a temperature above the Tg of the matrix polymer. The microbeads of cross-linked polymer are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred preform stretching operation simultaneously opens the microvoids and orients the matrix material. The final product properties depend on and can be controlled by stretching time-temperature relationships and on the type and degree of stretch. For maximum opacity and texture, the stretching is done just above the glass transition temperature of the matrix polymer. When stretching is done in the neighborhood of the higher glass transition temperature, both phases may stretch together and opacity decreases. In the former case, the materials are pulled apart, a mechanical anticompatibilization process. Two examples are high-speed melt spinning of fibers and melt blowing of fibers and films to form nonwoven/spun-bonded products. In summary, the scope of this invention includes the complete range of forming operations just described.

In general, void formation occurs independent of, and does not require, crystalline orientation of the matrix polymer. Opaque, microvoided films have been made in accordance with the methods of this invention using completely amorphous, noncrystallizing copolyesters as the matrix phase. Crystallizable/orientable (strain hardening) matrix materials are preferred for some properties like tensile strength and gas transmission barrier. On the other hand, amorphous matrix materials have special utility in other areas like tear resistance and heat sealability. The specific matrix composition can be tailored to meet many product needs. The complete range from crystalline to amorphous matrix polymer is part of the invention.

A transparent polymer base free of $TiO_2$ is preferred because the $TiO_2$ in the transparent polymer gives the reflective display materials an undesirable opalescence appearance. The $TiO_2$ pigmented transparent polymer of the prior art is also expensive because the $TiO_2$ must be dispersed into the entire thickness, typically from 100 to 180 $\mu$m. The $TiO_2$ also gives the transparent polymer support a slight yellow tint which is undesirable for a photographic display material. For use as a photographic reflective display material, a transparent polymer support containing $TiO_2$ must also be tinted blue to offset the yellow tint of the polyester causing a loss in desired whiteness and adding cost to the display material. Concentration of the white pigment in the polyolefin layer allow for efficient use of the white pigment which improves image quality and reduces the cost of the imaging support.

In the formation of photographic elements it is important that they be design to efficiently transport through processing equipment to minimize jamming and other problems. In such a case the back of said imaging member should have a roughness of between 0.3 and 2.0 $\mu$m. This range of roughness helps to modify the frictional characteristics to optimize the photographic finishing and transport of this material. Furthermore it is also desirable to control the roughness characteristic of the top most side. In this case it is desirable to incorporate roughness to help prevent finger printing and damage to the image side of the element. An improved roughness position also helps in assembling the display as a slightly non smooth surface will slide more easily into a display frame with protective over cover. In addition the roughened surface provides additional advantage in reducing gloss for those application that a softer mood or message is being created with the image material. The photographic imaging element of this invention may also be designed wherein the top of said imaging member has a surface roughness of between 0.02 and 0.2 $\mu$m.

The structure of a preferred biaxially oriented coextruded sheet where the silver halide imaging layers are coated on the polyethylene skin and the gelatin coated layer is as follows:

Polyethylene with blue pigment

Microvoided polyester layer with optical brightener and $TiO_2$

Solid polyester core

Coated gelatin layer

For the display material of this invention, at least one image layer containing silver halide and a dye forming coupler located on the top side or bottom side of said imaging element is suitable. Applying the imaging layer to either the top or bottom is suitable for a photographic display material, but it is not sufficient to create a photographic display material that is optimum for a transmission display. For the display material of this invention, at least one image layer comprises at least one dye forming coupler located on both the top and bottom of the imaging support of this invention is preferred. Applying an image layer to both the top and bottom of the support allows for optimization of image density while allowing for developer time less than 50 seconds.

The display material of this invention wherein said at least one dye forming layer on the opposite side of said transparent polymer sheet from the biaxially oriented polyolefin sheet has less dye forming coupler than the imaging layer on the same side as the biaxially oriented polyolefin sheet is suitable. It has been found that the duplitized emulsion top side to bottom side coverage ratio should be in a range of 1:0.6 to 1:1.25. It has been shown that the duplitized emulsion top side to bottom side coverage ratio of 1:1.25 resulted in significant and adverse attenuation of the imaging light which resulted in under exposure of the bottom side emulsion coating. Conversely, a duplitized emulsion top side to bottom side coverage ratio of less than 1:0.6 resulted in significant and adverse attenuation of the imaging light which resulted in over exposure of the top side emulsion coating. The preferred duplitized emulsion top side to bottom side coverage ratio is 1:1. A 1:1 ratio allows for efficient exposure and the required dye density for a quality image. The display material of this invention wherein at least one dye forming layer on the opposite side comprises about the same amount of dye forming coupler of the imaging layer on the same side as the biaxially oriented polyolefin sheet is most preferred. Coating substantially the same amount of light sensitive silver halide emulsion on both sides has the additional benefit of balancing the imaging element for image curl caused by the contraction and expansion of the hydroscopic gel typically found in photographic emulsions.

As used herein, the phrase "photographic element" or "imaging element" is a material that utilizes photosensitive silver halide in the formation of images. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

For the display material of this invention, at least one image layer containing silver halide and a dye forming coupler located on the top side or bottom side of said imaging element is preferred. Applying the imaging layer to either the top or bottom is preferred for a quality photographic transmission display material. For some markets improved image quality requires an increase in dye density. Increasing dye density increases the amount of light sensitive silver halide emulsion coated on one side. While the increase in emulsion coverage does improve image quality, developer time is increased from 50 seconds to 110 seconds. For the display material of this invention it is preferred that at least one image layer comprising at least one dye forming coupler is located on both the top and bottom of the imaging support of this invention is preferred. Applying an image layer to both the top and bottom of the support allows for optimization of image density with thinner photosensitive layers while allowing for developer time less than 50 seconds.

The display material of this invention wherein at least one dye forming layer on the top side comprises about the same amount of dye forming coupler of the imaging layer on the backside is most preferred. Coating substantially the same amount of light sensitive silver halide emulsion on both sides has the additional benefit of balancing the imaging element for image curl caused by the contraction and expansion of the hydroscopic gel typically utilized in photographic emulsions.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11), and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 Al (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 mm.

The elements of the invention may use materials as disclosed in *Research Disclosure*, 40145, September 1997, particularly the couplers as disclosed in Section II of the Research Disclosure.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition; |
| 2 | I, II, IX, X, XI, | morphology and preparation. |
| | XII, XIV, XV | Emulsion preparation |
| | I, II, III, IX | including hardeners, coating |
| 3 | A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | |
| 2 | XVII | Supports |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which compass the ultraviolet, visible, and infrared regions of the electromagnetic spectrum, as well as with electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

A method of imaging comprising providing a photographic member comprising a polymer sheet comprising at least one layer of voided polyester polymer and at least one layer comprising nonvoided polyester polymer, wherein the imaging member has a percent transmission of between 40 and 60%, the imaging member further comprises tints, and the nonvoided layer is at least twice as thick as the voided layer, and exposing said photographic imaging member to a collimated coherent light source is preferred. The imaging elements of this invention are preferably exposed by means of a collimated beam, to form a latent image, and then processed to form a visible image, preferably by other than heat treatment. A collimated beam is preferred, as it allows for digital printing and simultaneous exposure of the imaging layer on the top and bottom side without significant internal light scatter. A preferred example of a collimated beam is a laser also known as light amplification by stimulated emission of radiation. The laser is preferred because this technology is used widely in a number of digital printing equipment types. Further, the laser provides sufficient energy to simultaneously expose the light sensitive silver halide coating on the top and bottom side of the display material of this invention without undesirable light scatter. Subsequent processing of the latent image into a visible image is preferably carried out in the known RA-4™

(Eastman Kodak Company) Process or other processing systems suitable for developing high chloride emulsions.

The duplitized day/night display materials of this invention wherein said imaging element comprises at least one dye forming layer comprising silver halide and dye forming coupler on the opposite side of said transparent polymer sheet from the biaxially oriented polyolefin sheet and said exposure of both coupler containing layers is from the side of said imaging element having the biaxially oriented polyolefin sheet is preferred. This allows for traditional image processing equipment to be used. The imaging elements of this invention are preferably exposed by method of using a collimated beam, to form a latent image, and then processed to form a visible image, preferably by other than heat treatment. A collimated beam is preferred as it allows for digital printing and simultaneous exposure of the imaging layer on the top and bottom side without significant internal light scatter. A preferred example of a collimated beam is a laser also known as light amplification by stimulated emission of radiation. The laser is preferred because this technology is used widely in a number of digital printing equipment types. Further, the laser provides sufficient energy to simultaneously expose the light sensitive silver halide coating on the top and bottom side of the display material of this invention without undesirable light scatter. Subsequent processing of the latent image into a visible image is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Example 1

In this example the invention was compared to a typical prior art transmission display material. The invention was a duplitized silver halide emulsion coating support containing a thin skin layer of polyethylene on the top of a microvoided layer integrally attached to a transparent polyester base. The prior art material and the invention were measured for % transmission, lightness, color and illuminant show through. This example will show a reduction in the yellowness of a density minimum area and reduction in developer time compared to the prior art materials.

The following prior art transmission display material was used as a comparison for the invention:

Kodak Duratrans (Eastman Kodak Co.), is a one side color silver halide coated polyester support that is 180 $\mu$m thick. The support is a clear gel subbed polyester. The silver halide emulsion contains 200 mg/ft$^2$ of rutile $TiO_2$ in the bottom most layer. The following photographic day/night display material of the invention was prepared by coextrusion of a biaxially oriented polyester sheet containing a microvoided skin layer with a second skin layer over top of the microvoided skin layer. The base core of this structure was a clear polyester that was subbed on the bottom most side with an adhesion promoting material to enhance the adhesion of gelatin from the light sensitive emulsion to the imaging member.

The optical brightener used was Hostalux KS manufactured by Ciba-Geigy. Anatase $TiO_2$ was added at 10% by weight of base polymer. The $TiO_2$ type was Kronos 1014 (a 0.22 $\mu$m particle size $TiO_2$). Table 1 below lists the characteristics of the layers of the top biaxially oriented sheet used in this example.

TABLE 1

| | | |
|---|---|---|
| L1 | LDPE + DuPont Bynel 2169 + $TiO_2$ | 5 |
| L2 | Voided Polyester + Optical Brightener | 24.9 |
| L3 | Polyester (Transparent) | 80 |
| L4 | Gel Sub Layer | 0.762 |

The Low Density Polyethylene was Eastman Chemcial D4002P (0.917 g/cc), Dupont Bynel 2169 was added at 35% by weight with 0.07% pigment blue 60. The optical brightener was Hostalux KS manufactured by Ciba-Geigy and the gel sub layer was a gelatin based layer to promote adhesion to the polyester and photosensitive layer.

Coating format 1 was utilized to prepare photographic day/night display material and was coated on the L1 polyethylene layer on the top coextruded biaxially oriented polyester sheet. The same coating coverage was coated on both the L1 polyethylene layer on the top biaxially oriented sheet and on the bottom gel sub layer.

| Coating Format 1 | Laydown mg/m$^2$ |
|---|---|
| Layer 1 Blue Sensitive Layer | |
| Gelatin | 1300 |
| Blue sensitive silver | 200 |
| Y-1 | 440 |
| ST-1 | 440 |
| S-1 | 190 |
| Layer 2 Interlayer | |
| Gelatin | 650 |
| SC-1 | 55 |
| S-1 | 160 |
| Layer 3 Green Sensitive | |
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer 4 UV Interlayer | |
| Gelatin | 635 |
| UV-1 | 30 |
| UV-2 | 160 |
| SC-1 | 50 |
| S-3 | 30 |
| S-1 | 30 |
| Layer 5 Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer 6 UV Overcoat | |
| Gelatin | 440 |
| UV-1 | 20 |
| UV-2 | 110 |
| SC-1 | 30 |
| S-3 | 20 |
| S-1 | 20 |

-continued

| Coating Format 1 | Laydown mg/m$^2$ |
|---|---|
| Layer 7 SOC | |
| Gelatin | 490 |
| SC-1 | 17 |
| $SiO_2$ | 200 |
| Surfactant | 2 |

APPENDIX

Y-1

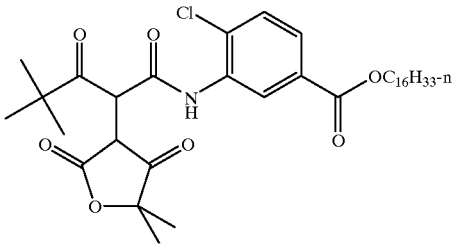

ST-1 = N-tert-butylacrylamide/n-butyl acrylate copolymer (50:50)

S-1 = dibutyl phthalate

SC-1

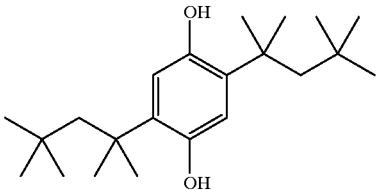

M-1

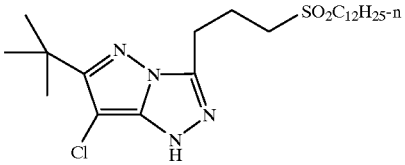

S-2 = diundecyl phthalate

ST-2

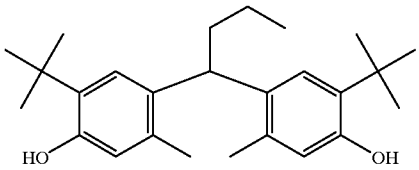

ST-3

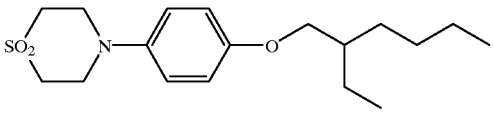

ST-4

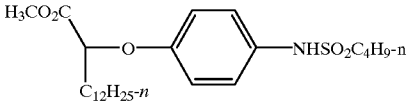

-continued

UV-1

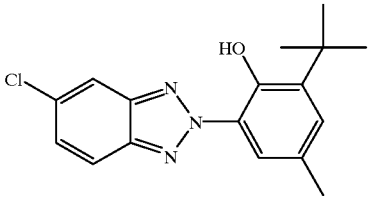

UV-2

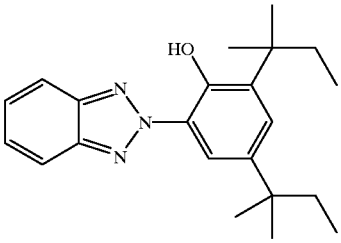

S-3 = 1,4-Cyclohexyldimethylene bis(2-ethylhexanoate)

C-1

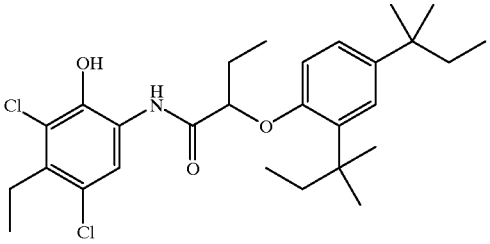

S-4 = 2-(2-Butoxyethoxy)ethyl acetate

Dye 1

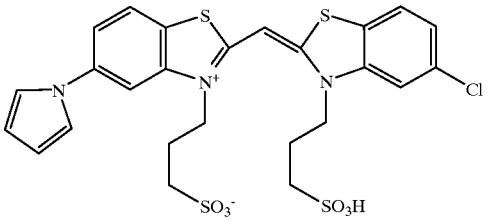

The structure of the invention photographic day/night element in this example was as follows:

Coating format 1

DuPont Bynel + Low Density Polyethylene with $TiO_2$

Voided Polyester w OB

Transparent polyester base

Gelatin sub coating

Coating format 1

The display material was processed as a minimum density. The display supports were measured for status A transmission using an X-Rite Model 310 photographic densitometer. Spectral transmission is calculated from the Status A density readings and is the ratio of the transmitted power to the incident power and is expressed as a percentage as follows; $T_{RGB}=10^{-D}*100$ where D is the average of the red, green and blue Status A transmission density response. The display material were also measured for L*, a* and b* using a Spectrogard spectrophotometer, CIE system, using illuminate D6500. In the transmission mode, a qualitative assessment was made as to the amount of illuminating backlighting show through. A substantial amount of show through would be considered undesirable as the show through of the light sources could interfere with the image quality. The comparison data for invention and control are listed in Table 2 below.

TABLE 2

| Measure | Invention | Control |
|---|---|---|
| % Transmission | 39% | 49% |
| CIE D6500 L* | 58 | 70.02 |
| CIE D6500 a* | 0.2 | −0.62 |
| CIE D6500 b* | 3.59 | 11.14 |
| Illuminating Backlight Showthrough | None | Slight |

The day/night display support coated on the top and bottom sides with the light sensitive silver halide coating format of this example exhibits all the properties needed for an photographic transmission and reflection display material. Further the photographic day/night display material of this example has many advantages over prior art photographic display materials. The non-voided layers have levels of $TiO_2$ and colorants adjusted to provide an improved minimum density position compared to prior art prior art transmission display materials as the invention was able to overcome the native yellowness of the processed emulsion layers (b* for the invention was 3.59 compared to a b* of 11.14 for prior art transmission materials). In the transmission mode, the illuminating backlights did not show through the invention indicating a superior transmission product compared to the prior art.

The % transmission for the invention (39%) provides an superior transmission image as more light was transmitted from the illuminating light source. Further, concentration of the tint materials and the white pigments in the biaxially oriented sheet allows for improved manufacturing efficiency and lower material utilization resulting in a lower cost display material compared to the prior art. The a* and L* for the invention are consistent with a high quality transmission display materials.

Surprisingly, when images were printed on the invention material by exposing the top side only with a laser, no distortion in the backside image was observed. This allows simultaneous printing of the top and bottom imaging layers without any misregistration of the images. The addition of the voiding layer allowed for the required opacity to prevented filament show through yet allowed simultaneous imaging of the top and bottom sides eliminating any bottom image distortion. Finally, the invention had a developer time of 45 seconds compared to a developer time of 110 seconds for prior art transmission display materials. A 45 second developer time has significant commercial value in that this the display material of this invention can significantly increase the productivity of processing equipment.

The invention has been described in detail with particular reference to preferred embodiments thereof, but it will be understood that variations and modifications can be effected within the spirit and scope of the invention.

What is claimed is:

1. A photographic imaging member comprising at least one photosensitive silver halide layer on the top of said member and at least one photosensitive silver halide layer on the bottom of said member, a polymer sheet comprising at least one layer of voided polyester polymer and at least one layer comprising nonvoided polyester polymer, wherein the photographic imaging member has a percent transmission of between 38 and 42%, the imaging member further comprises tints, and the nonvoided layer is at least twice as thick as the voided layer.

2. The photographic imaging member of claim 1 wherein said polymer sheet is oriented.

3. The photographic imaging member of claim 1 wherein said polymer sheet comprises at least one polyethylene layer.

4. The photographic imaging member of claim 1 wherein said member further comprises at least one subbing layer.

5. The photographic imaging member of claim 1 wherein said void space comprises between about 2 and 60% by volume of said voided layer of said polymer sheet.

6. The photographic imaging member of claim 1 wherein said imaging member has a thickness of between 76 and 256 mm.

7. The photographic imaging member of claim 1 wherein said tints comprise bluing tints.

8. The photographic imaging member of claim 1 wherein said polymer sheet comprises optical brighteners.

9. The photographic imaging member of claim 1 wherein said polymer sheet contains white pigments.

10. The photographic imaging member of claim 1 wherein photographic imaging member further comprises an antihalation layer.

11. The photographic imaging member of claim 1 wherein a top layer and a bottom layer comprise a photosensitive silver halide and a dye forming coupler.

12. The photographic imaging member of claim 1 wherein said member further comprises a layer of polyethylene polymer on top of said voided polyester layer.

13. The photographic imaging member of claim 3 wherein at least one layer below said polyethylene containing layer comprises a charge control agent having an electrical resistivity of less than $10^{11}$ ohms per square.

14. The photographic imaging member of claim 1 wherein said voided layer contains organic particles that are the voiding initiating material for said voided layer.

15. The photographic imaging member of claim 1 wherein the back of said imaging member has a surface roughness of between 0.3 and 2.0 mm.

16. The photographic imaging member of claim 1 wherein the top of said imaging member has a surface roughness of between 0.02 to 0.2 $\mu$m.

17. The photographic imaging member of claim 1 wherein said voided layer has a thickness between 6 and 50 $\mu$m.

18. A method of photographic imaging comprising providing a photographic imaging member comprising at least one photosensitive silver halide layer on the top of said member and at least one photosensitive silver halide layer on the bottom of said member, a polymer sheet comprising at least one layer of voided polyester polymer and at least one layer comprising nonvoided polyester polymer, wherein the photgraphic imaging member has a percent transmission of between 38 and 42%, the imaging member further comprises tints, and the nonvoided layer is at least twice as thick as the voided layer, and exposing said photographic imaging member to a collimated coherent light source.

19. The photographic imaging member of claim 3 wherein at least one layer below said polyethylene containing layer comprises a charge control agent having electrical neutral charging in relation between the backside most layer of said element and the top most layer of the photosensitive silver halide emulsion.

20. The method of claim 18 wherein said polymer sheet is oriented.

21. The method of claim 20 wherein said polymer sheet compromises at least one polyethylene layer.

22. The method of claim 18 wherein said void space comprises between about 2 and 60% by volume of said voided layer of said polymer sheet.

23. The method of claim 21 wherein said tints comprise bluing tints.

24. The method of claim 23 wherein photographic imaging member further comprises an antihalation layer.

25. The method of claim 18 wherein a top layer and a bottom layer comprise photosensitive silver halide and dye forming coupler.

* * * * *